US005954625A

United States Patent [19]

Giesler, Sr.

[11] Patent Number: 5,954,625

[45] Date of Patent: Sep. 21, 1999

[54] METHOD AND APPARATUS FOR EMBOSSING CONTINUOUS PAPER WEBS

[75] Inventor: Edward J Giesler, Sr., Pulaski, Wis.

[73] Assignee: Industrial Engraving & Manufacturing, Corp., Pulaski, Wis.

[21] Appl. No.: 08/868,515

[22] Filed: Jun. 4, 1997

[51] Int. Cl.[6] ..... B31F 1/07

[52] U.S. Cl. ..... 493/396

[58] Field of Search ..... 101/6, 16, 23, 101/28; 493/396, 355, 402, 403, 381, 384, 394, 392, 390, 351, 350, 346, 464

[56] References Cited

U.S. PATENT DOCUMENTS

| | | | |
|---|---|---|---|
| 453,564 | 6/1891 | Peterson | 101/28 |
| 690,822 | 1/1902 | Avril | 101/23 |
| 1,150,805 | 8/1915 | Beran | 101/23 |
| 1,856,898 | 5/1932 | Wood | 101/23 |
| 2,277,725 | 3/1942 | Smith et al. | 29/18 |
| 2,729,267 | 1/1956 | Walton | 154/1 |
| 2,937,591 | 5/1960 | Wagner | 101/23 |
| 3,005,364 | 10/1961 | Broderick | 101/28 X |
| 3,022,231 | 2/1962 | Broderick | 101/28 X |
| 3,264,978 | 8/1966 | Staley | 101/23 |
| 3,323,983 | 6/1967 | Palmer | 162/362 |
| 3,608,047 | 9/1971 | Wiggins | 364/286 |
| 3,650,882 | 3/1972 | Thomas | 156/183 |
| 3,655,312 | 4/1972 | Erb et al. | 101/23 X |
| 4,280,978 | 7/1981 | Dannheim | 264/156 |
| 4,361,085 | 11/1982 | Schutz | 101/23 |
| 4,614,632 | 9/1986 | Kozuka | 264/380 |
| 4,732,082 | 3/1988 | Ireton | 101/23 |
| 4,888,145 | 12/1989 | Allner | 264/126 |
| 4,913,911 | 4/1990 | Wildt | 425/385 |
| 4,927,588 | 5/1990 | Schutz | 264/238 |
| 5,158,523 | 10/1992 | Houk | 493/396 |
| 5,529,563 | 6/1996 | Veith et al. | 493/403 X |

*Primary Examiner*—Joseph J. Hall, III
*Assistant Examiner*—Anthony Ojini
*Attorney, Agent, or Firm*—Sokol Law Office; Jeffrey S. Sokol

[57] ABSTRACT

Method and apparatus are disclosed for embossing paper webs using opposing embossing and imprint rolls. In the preferred embodiment the embossing roll and the imprint roll have differing diametrical dimensions, thereby producing differing velocities through the nip, causing the embossing projections, of the embossing roll to sweep through modified imprint cells of the imprint roll, thereby affecting an automatic sweeping of accumulated debris from the imprint cell as the embossing operation take place.

20 Claims, 5 Drawing Sheets

METHOD AND APPARATUS FOR EMBOSSING CONTINUOUS PAPER WEBS

BACKGROUND OF THE INVENTION

The present invention relates to a method and apparatus for embossing a pattern upon a continuous web of paper, as the web passes between a pair of opposed metal embossing rolls.

1) Field Of The Invention

This invention relates to method and apparatus for embossing a pattern upon a continuous web of paper, typically used for paper napkins, toilet tissue, and the like, by passing the web between a pair of matched pattern embossing rolls. Typically, in such apparatus and methods, as the web passes through the nip, between the rolls, debris is forced out of the paper, and tends to stick to the embossing roll surfaces, shortening roll life.

By the invention, as disclosed herein, an improvement in such apparatus and method is taught, whereby the resulting debris residue is inherently cleaned from the apparatus simultaneously, as the web of paper is embossed.

2) Description Of The Prior Art

Embossing rolls are cylindrical rolls, mounted tangentially parallel and spaced apart to form a nip, therebetween, at the line of roll tangency.

Prior art rolls, are typically of the same diameter, and are rotated inward towards the nip at the same rotational speed. At a point in the nip, equidistant from the center of each roll, embossing projections, extending outward from the embossing roll, and concave imprinting cells, within the opposing imprint roll, move at the same linear speed. The embossing roll, with its embossing projections radially extending from the outer surface, is rotated in timed relationship, with the opposing imprint roll, whereby the embossing projections mesh with the embossing imprint cells, on the opposing imprint roll.

The paper web, as it passes through the nip, is tamped into the imprint cells, by the embossing projections. Tamping the web into the cells, by the tightly fitting projections, embosses a pattern into the web. Embossing paper webs, using a pair of mated steel rolls, is a production technique used to manufacture toilet tissue, paper hankies, paper napkins, paper towels, and like products.

The paper webs, now being received by converters, for embossing, are generally made from recycled paper and inherently contain adherent debris. The debris in the paper generally comprises a mixture of cellulose, latex, and tar. The cellulose, latex, and tar is adherent and sticky.

The presence of such adherent debris, in the recycled paper webs, shortens roll life because of an inherent debris build-up, which occurs within the imprint cells during the embossing operation.

Machine operational speeds are becoming faster, and paper web widths have increased beyond those addressed by prior art. New problems have begun to occur with the increasing speed of paper web embossing machines employing mated steel embossing rolls and using recycled paper webs with their adherent debris content.

When an imprint embossing cell fills with debris, there is no longer clearance between the male embossing projection, and the imprint cell. Thus the web is no longer tamped into the imprint cell, as desired, but is pounded between the male embossing projection and the debris build-up within the imprint cell. The pounding of the embossing projections against the hard debris accumulated within the cell, peens the embossing projections. The peened embossing projections, act to widen the cells as the peened embossing projections pound against the cell walls. A typical symptom of debris build-up, is tearing of the web during the embossing operation; another symptom of debris build up, is poor definition of the pattern embossed into the paper. When the web tears, or the pattern is no longer sharp, the mated rolls must be replaced.

One common, prior art, method used to extend roll life is to merely increase the clearance between the embossing projection and the imprint cell. Thus the embossing projection, and the matching cell is typically etched to create more clearance whereby the cell may hold a greater amount of debris before replacement of the rolls becomes necessary.

Periodically scrubbing the imprint cells to remove the adherent debris, has also been tried in the prior art. However, the debris becomes as hard as glass as a result of the hammering of the embossing projection into the imprint cell and has proven difficult to remove.

Brush rolls, mounted tangent to the imprint rolls, and bearing against the imprint cells, have also been tried in the prior art to continuously clean the imprint cells during the embossing operation.

3) Related References

A prior art patent search has been conducted which resulted in the discovery of the following related references:

a) Methods for embossing paper, to form napkins, paper towels, and toilet tissue is taught in Walton, U.S. Pat. No. 2,729,267, Walton discloses an embossing device wherein a decorative embossed pattern is formed about the periphery of a paper product, such as a napkin, thereby leaving a smooth center area.

b) An embossing machine consisting of an embossing roll and a matching imprint roll is disclosed in Palmer Et Al. U.S. Pat. No. 3,323,983. Palmer addresses the problem of adherent debris build up by providing the imprint roll with open ended circumferential grooves, into which the embossable paper is pressed by male projections on the embossing roll. The open ended grooves permit accumulated debris therein to fall from of the grooves as the imprint roll, upon which the grooves are carried, rotates, during the embossing operation. Alternatively, Palmer teaches the use of a system of brushes, attached to the embossing roll, to clean the grooves of the imprint roll as the rolls rotatingly separate.

c) Nystrand, U.S. Pat. No. 3,867,872, teaches use of a wheel and anvil, to bond and emboss paper products.

d) Schulz, U.S. Pat. No. 4,927,588, discloses embossing a pattern into a multi-ply, continuous paper web, by using a pair of opposed embossing rolls. After embossing a multi-ply web, the plies are separated from one another and longitudinally displaced, relative to one another, and recombined into a multi-ply sheet with the embossments out of register with one another. The device as taught in Schulz incorporates a steel embossing roll, and a rubber roll as the platen.

e) Houk, U.S. Pat. No. 5,158,523, teaches use of a steel embossing roll, as in Schulz, U.S. Pat. No. 4,927,588, rollingly engaging a matching imprint roll having a resilient, impressionable surface and forming a nip therebetween. Projections, in the form of truncated pyramids, on the perimeter of the embossing roll extend outwardly therefrom and imprintingly engage the impressionable surface of the imprint roll. A web passing through the nip, between the embossing roll and the imprint roll, is embossed as the pattern of truncated rectangular pyramids is forced into the impressionable surface of the imprint roll.

In an alternate embodiment, Houk teaches a steel, non-impressionable, imprint roll having a plurality of pyramidal cavities machined into the roll surface wherein he truncated rectangular pyramids, on the embossing roll, tamp the web into the pyramidal cavities at the nip.

SUMMARY OF THE INVENTION

It is an object of the present invention to provide a method and apparatus by which the adherent web debris is continuously removed from the imprint cells during an embossing operation.

It is an object of this invention, to use the wiping and stretching properties of embossable paper, to sweep the adherent debris, found in recycled paper, out of the imprint cell, as the web is being embossed.

It is an object of the invention to change the shape of the imprint cell, so that adherent debris is swept out of the imprint cell, by lengthening the imprint cell, in the machine direction.

It is an object of the invention to emboss a pattern by forming the web, between the side walls and the bottom of a modified imprint cell, and the embossing projections.

It is an object of the invention to increase productivity of a web embossing machine, by lessening the down time currently required for cleaning and/or replacing rolls.

It is an object of the invention to change the embossing technology, to emboss, while sweeping a projection through the imprint cell, rather than by tamping the paper to be embossed, into the imprint cell, by the projection.

It is an object of the invention to rotate the embossing roll and the imprint roll, such that there is a surface speed differential between the imprint cell, and embossing projection, meshing at the nip.

It is an object of the invention, to rotate both the embossing roll and the imprint roll, while meshing, at a different linear speed, as measured at one point on the embossing projection at mesh, and measured at a second point on the imprint cell, at mesh.

It is an object of the invention, to sweep debris out of the imprint cell, by making one embossing roll of a smaller diameter than its opposed embossing roll.

It is an object of the invention, to rotate opposed embossing rolls of different diameters, towards the nip, creating a differential speed at the nip between the imprint cell, and the male embossing projection.

DETAILED DESCRIPTION OF THE INVENTION

It is to be noted that in describing the present invention herein the embossable paper web, as illustrated in FIGS. 1 through 4, is not shown all figures, in order to simplify the illustrations and the disclosure. Even though the embossable paper web is not illustrated in the said figures, one skilled in the art of manufacturing such products will readily understand the principles and operation of the herein disclosed and claimed invention.

Figure 1:
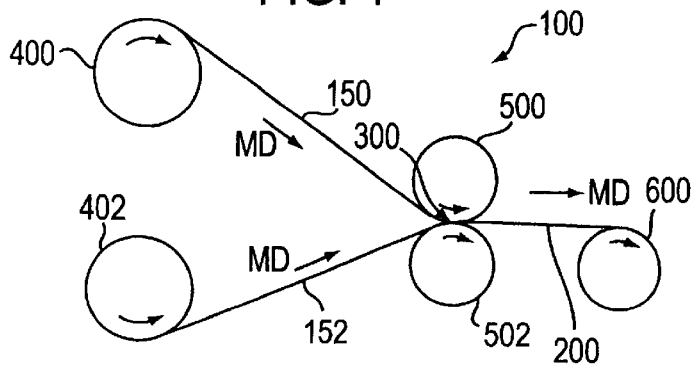
FIG. 1 is a schematic of an embossing device suitable for embodying the present invention having two parent rolls, a web, a matched pair of embossing rolls, and a finished roll.

FIG. 1 presents a schematic of a machine 100 for embossing a pattern into a continuous paper web 200. Web 200 is typically formed of two continuous sheets of embossable paper 150 and 152 supplied upon parent feed rolls 400 and 402. Continuous sheets 150 and 152 are fed, in an overlapping relationship, into nip 300 between rotating male embossing roll 500 and female imprint roll 502. Rolls 500 and 502 are mounted parallel to and one above the other, in meshing relationship and are rotated inward towards nip 300 in the machine direction MD thereby carrying the resulting composite web 200 through nip 300 and onto finished roll 600.

Figure 2:
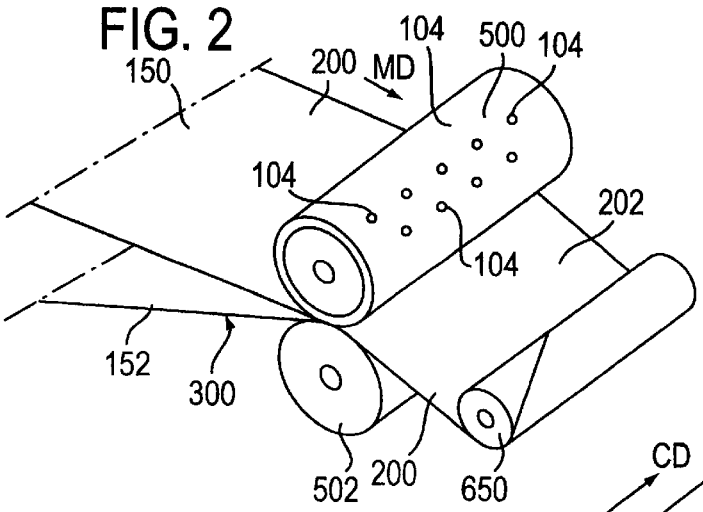
FIG. 2 is a partial perspective of an embossing device for embodying the present invention.
Figure 3:
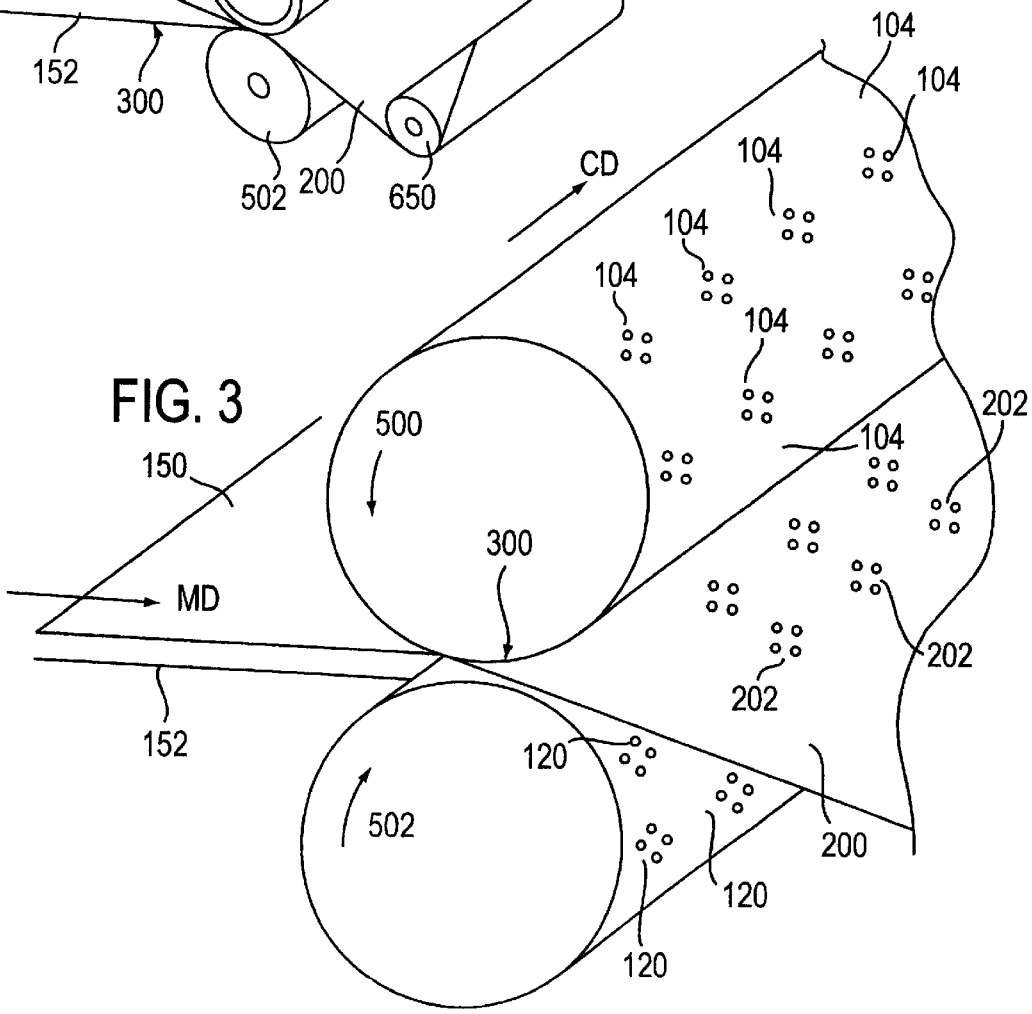
FIG. 3 is a partial perspective of a male embossing roll and a matching female imprint roll, one mounted above the other.

Referring additionally to FIGS. 2 and 3, embossing roll 500 is provided with a pattern of radially extending male embossing projections 104 in matched relation to a pattern of radially inward extending female imprint cells 120 upon imprint roll 502. As the embossable paper sheets 150 and 152 are drawn into and through nip 300, the interaction of embossing projections 104 and imprint cells 120 emboss a decorative pattern 202 upon the composite web 200. Embossed pattern 202 may serve one of two functions or both. First the embossed pattern 202 may function to "knit" the two separate sheets 150 and 152 together and/or may also serve to provide a decorative pattern within the finished composite web 200.

Figure 4:
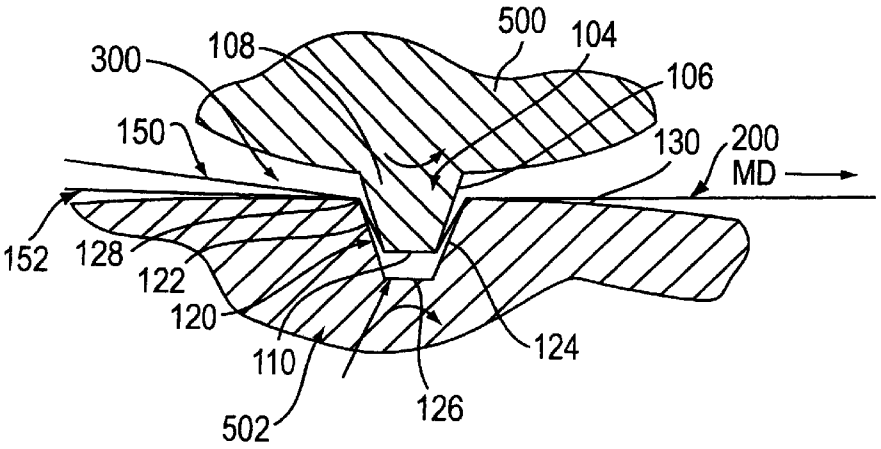
FIG. 4 PRIOR ART
FIG. 4 is a partial sectional view, in elevation, showing a typical prior art male and female embossing roll combination, one mounted one above the other.

Referring now to FIG. 4 an expanded cross sectional view is illustrated of a typical Prior Art embossing roll 500 and imprinting roll 502, in meshing engagement, at nip 300 and rotating such as to advance web 200 in the machine direction MD. Male projection 104 generally comprises end walls 106 and 108 and bottom surface 110. Imprint cell 120 generally comprises a matching U-shaped, concave, indentation having side surfaces 122 and 124, and bottom surface 126. Surface 128 and surface 130 form the top of cell 120.

Typically as sheets 150 and 152, forming web 200, are fed into nip 300 between rolls 500 and 502 and pass therethrough, movement of projection 104 into and out of cell 120, causes web 200 to be tamped into cell 120 thereby embossing decorative pattern 202, into the composite 200.

Figure 5:
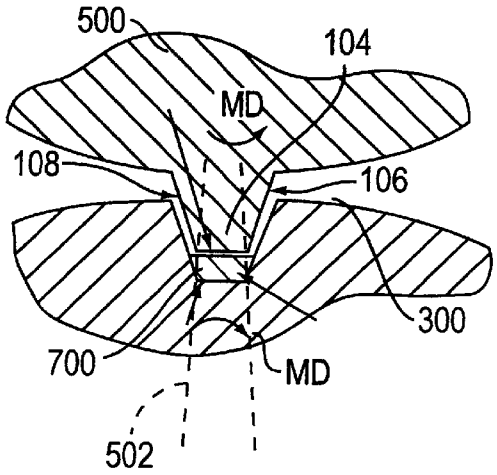
FIG. 5 PRIOR ART
FIG. 5 is a partial sectional view, similar to FIG. 4, illustrating the accumulation of debris experienced in prior art apparatus of the type illustrated in FIG. 4.

Referring additionally to FIG. 5, the typical Prior Art build-up of debris 700 that is released from web 200 during tamping and collecting within cell 120 over a period of time is illustrated. The amount of debris collected within cell 120 continues to increase with time and, by the tamping action of the embossing roll projections 104 is continuously compacted at the bottom of cell 120. As the accumulation of debris increases and continues to be compacted the working depth of cell 120 continuously decreases and projections 104 begin to impact an ever growing, hard, compact surface created by the compacted debris which eventually results in damage to projections 104 unless the machine is stopped and the compacted debris removed from cells 120.

Figure 6:
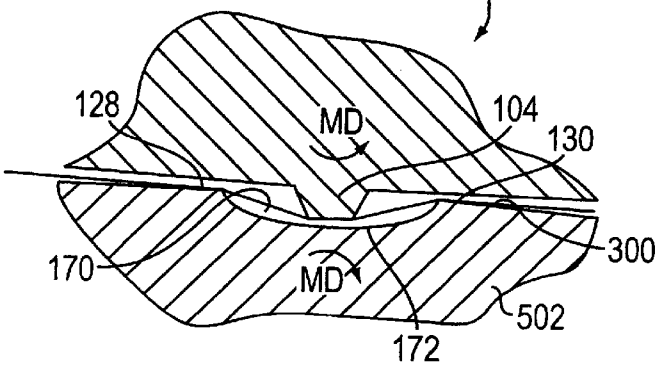
FIG. 6 is a partial sectional view, similar to FIGS. 4 and 5, generally illustrating a modified imprint cell in accord with the present invention.

FIG. 6 presents a view similar to FIG. 4 wherein an improved imprint cell 170 embodying the present invention is generally illustrated. Prior Art cell end walls 122 and 124, and bottom surface 126 have been reconfigured to form a smooth, continuous, concave, generally elliptical surface 172 extending from cell top surface 128 to opposite top surface 130. The lateral configuration of the cell 170, in the machine's cross direction CD, is unchanged and continues to comprise generally radially extending, planar, side walls having a CD dimension so as to accommodate the CD dimension of projection 104.

In operation, projection 104 not only penetrates cell 170, thereby embossing web 200 as it passes between rolls 500 and 502, but also, in accord with the present invention, sweeps across elliptical surface 172 from cell top surface 128 to opposite top surface 130 thereby causing projection 104, and the embossed portion of web 200, to push any accumulated debris out of the cell ahead of projection 104. Thus there must be relative movement between projection 104 and elliptical surface 172 as they pass, in meshed relation, through nip 300. Therefore, if rolls 500 and 502, have equal diameters they must rotate at different rotational speeds to produce the required sweeping movement of embossing projection 104 through imprint cell 170. Alternatively, and most preferred, rolls 500 and 502 may by of different diameters as illustrated in FIG. 7, and may also rotate at the same or different rotational speed.

The difference in linear speed, between the male embossing roll and its opposed female embossing roll as they pass through nip 300, creates the desired sweeping action, at the line of embossing, i.e. the line of tangency between the two rolls. The sweeping motion, between projection 104 and cell 170, cleans out debris from the imprint cell. The meshing action of projection 104 with cell 170 also simultaneously embosses the web, on the side wall of imprint cell 170, and the bottom surface 172 of the imprint cell, rather than tamping the web between the walls of the imprint cell 120, and the male projection 104, as in the Prior Art. The Prior Art tamping causes the build up and hardening of debris within the imprint cell, which the sweeping motion of the present invention prevents. Herein the sweeping action of embossing projection 104 through imprint cell 170 is referred to as "sweep". Sweep is thus defined as the difference in velocity between a point on the tip of the male embossing projection 104, and a point in the female imprint cell 170, measured at the nip.

Figure 7:
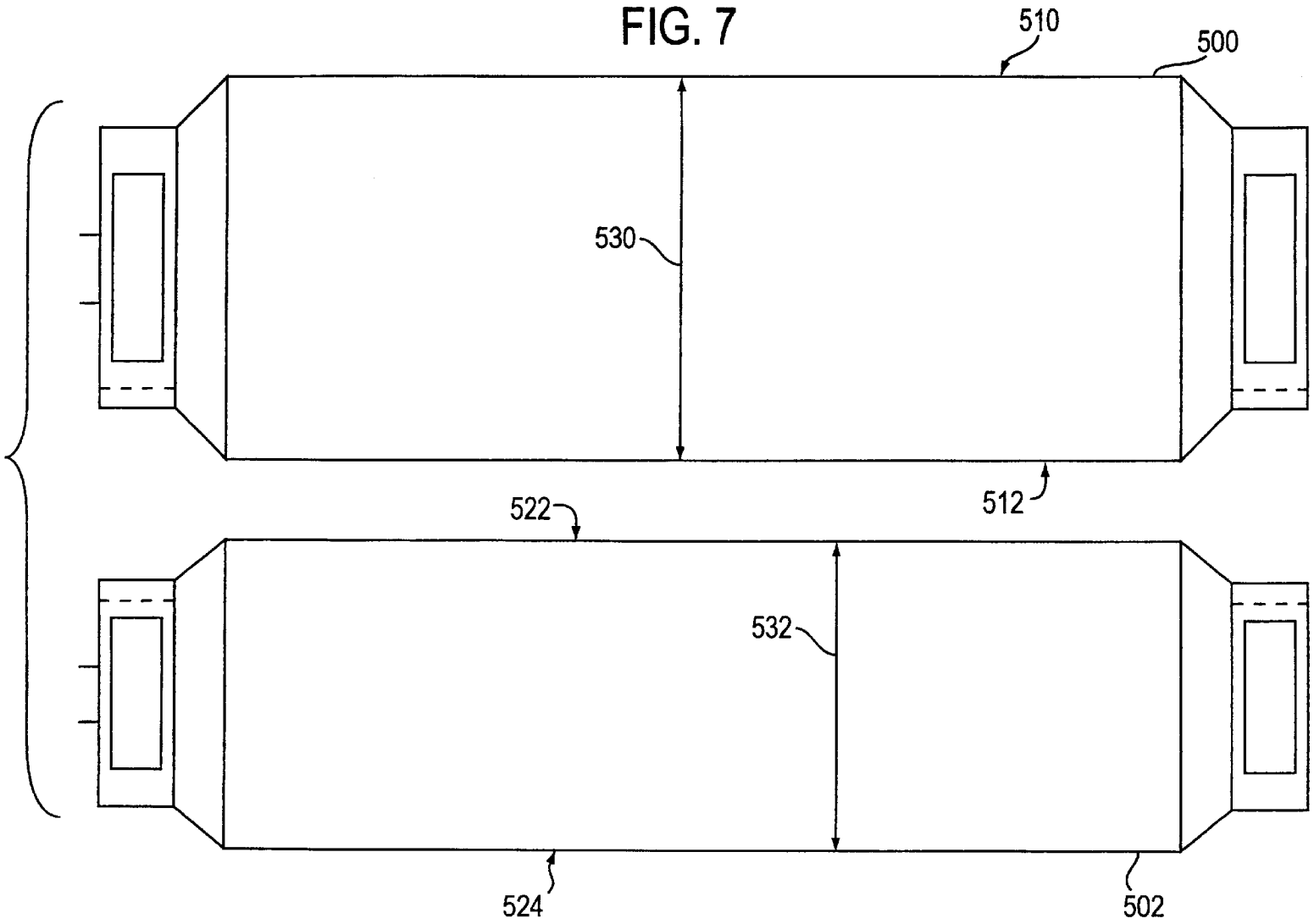
FIG. 7 is a an elevational view looking into the nip of a pair of embossing rolls suitable for embodying the present invention.

FIG. 7 shows an embossing roll 500 and an imprint roll 502 having differing diameters as measured across points 510 and 512, and points 522 and 524 respectively, whereby embossing roll 500 has a large diameter 530 and imprint roll 502 has a smaller diameter 532.

Figure 8A:
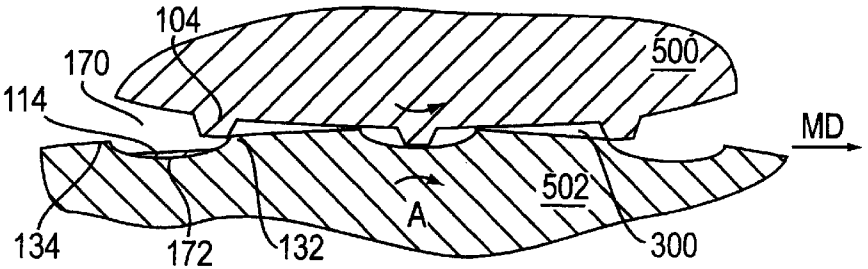
FIG. 8*a, b* and *c* are schematics showing the movement of debris out of the modified imprint cell through one embossing cycle, with a small diameter male embossing roll.
Figure 8B:
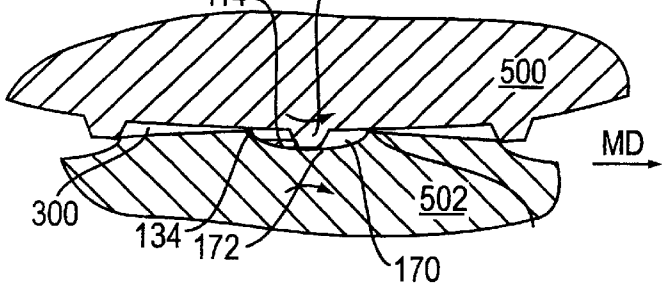
Figure 8C:
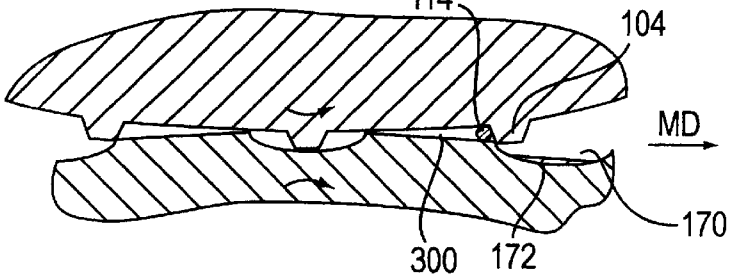

Referring now to FIG. 8. FIGS. 8*a,* 8*b,* and 8*c* illustrate an embodiment of the present invention wherein the male embossing roll 500 is smaller in diameter than the female imprint roll 502. In such an embodiment the larger imprint roll 502 is moving faster than the smaller embossing roll 500. In FIG. 8*a,* embossing projection 104 is shown as it first enters cell 170 at the cell's leading edge 132. Debris 114 is shown as having collected in the bottom of cell 170. Since imprint roll 502 is moving faster than embossing roll 500, cell 170 affectively "sweeps past" projection 104 as the meshing embossing projection 104 and imprint cell 170 advance along the machine direction MD and through nip 300 thereby causing embossing projection 104 to not only emboss the paper web (not shown) therebetween but to also sweep through cell 170. As embossing projection 104 sweeps through cell 170, from right to left, as viewed in FIG. 8*b,* the collected debris 114, within cell 170, is swept or pushed along the floor 172 of cell 170 ahead of projection 104. As projection 104 exits cell 170, at the cells trailing edge 134, the accumulated debris 114 has also exited cell 170 ahead of projection 104 as illustrated in FIG. 8*c.* Thus accumulated debris left behind from the previous embossing operation within cell 170 is swept clear of the cell by the following embossing operation as it progresses within the cell.

Figure 9A:
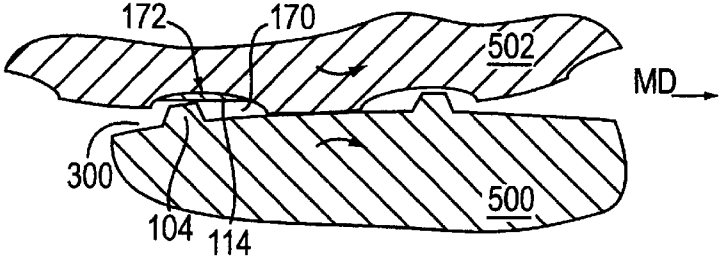
FIG. 9*a, b,* and *c* are schematics, similar to FIG. 9, showing the movement of debris out of the modified imprint cell through one embossing cycle, with a large diameter male embossing roll.
Figure 9B:
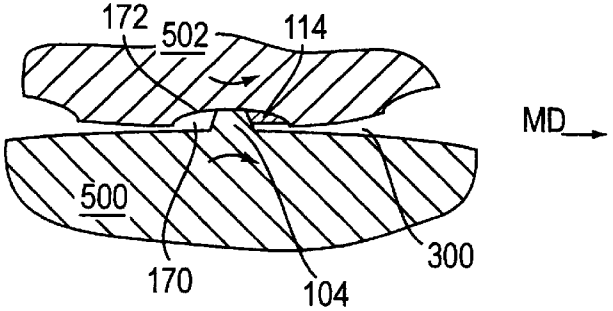
Figure 9C:
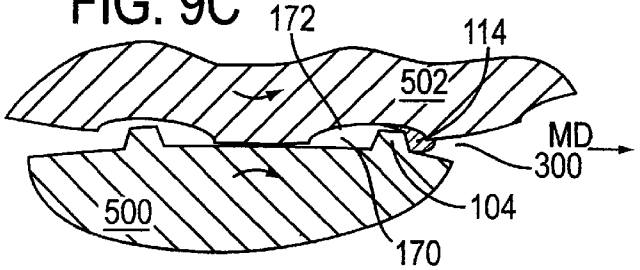

Now referring to FIG. 9. FIGS. 9*a,* 9*b,* and 9*c* similarly illustrate an embodiment of the present invention wherein the male embossing roll 500 is larger than the female imprint roll 502. In such an embodiment the larger embossing roll 500 is moving faster than the smaller imprint roll 502. Once again, following the relative progression of embossing projection 104 and imprint cell 170 through the figures, embossing projection 104 is shown entering cell 170 as projection 104 begins to mesh with cell 170 as illustrated in FIG. 9*a.* Because of the relatively faster speed of the embossing roll 500, projection 104 is caused to sweep through cell 170, from left to right as viewed in FIG. 9, as the meshing projection 104 and cell 170 pass through nip 300. Thus debris 114, accumulated from the previous embossing operation within cell 170, is swept ahead of embossing projection 104 as projection 104 advances through cell 170, as illustrated in FIG. 9*b.* As projection 104 continues its sweep through cell 170, accumulated debris 114 is ejected from cell 170 ahead of projection 104 as projection 104 exits cell 170, to the right, as illustrated in FIG. 9*c.*

Figure 10:
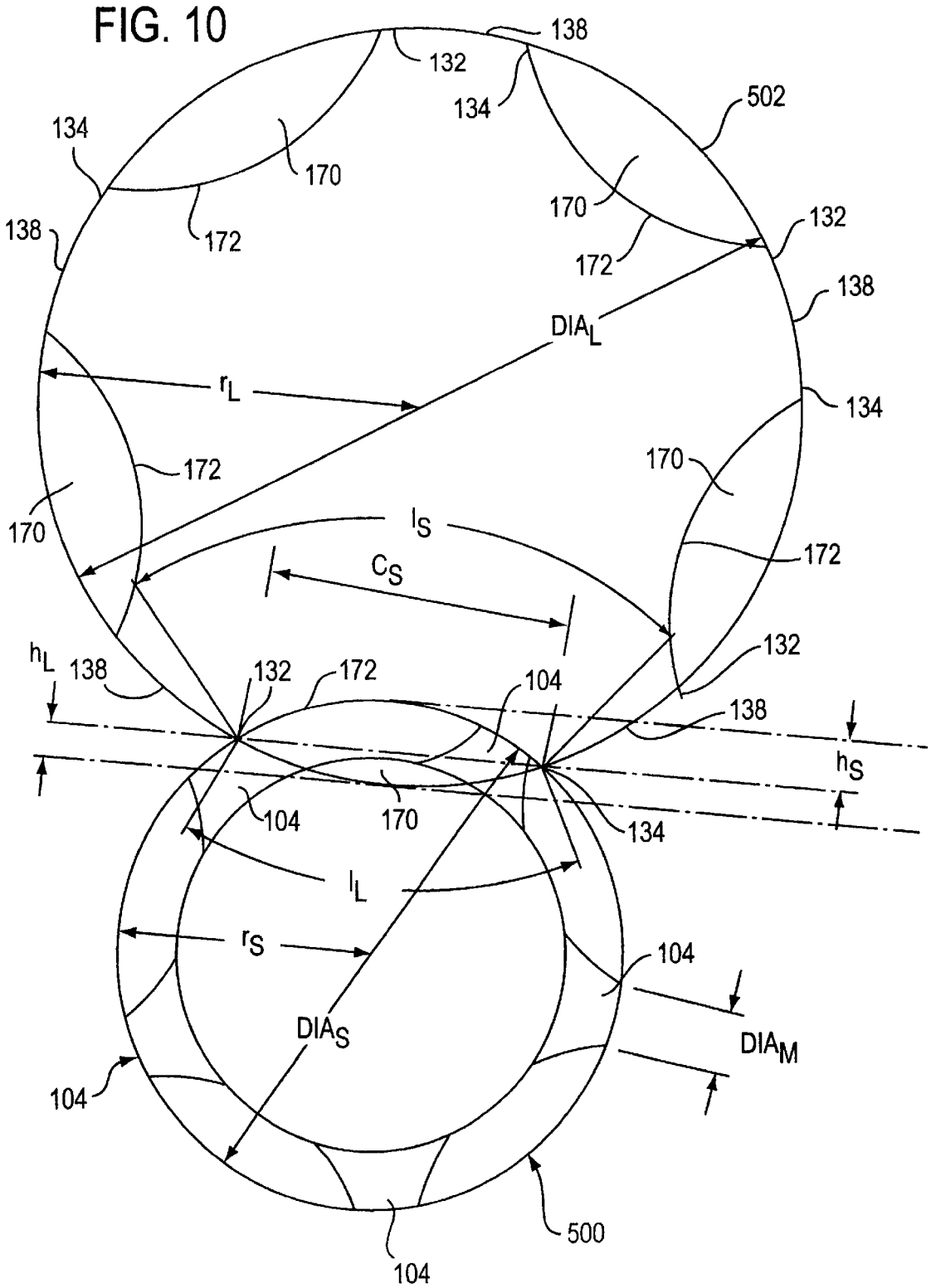
FIG. 10 is a distortion diagram from which the dimensions and configuration of the modified imprint cell, in accord with the present invention, are determined.

FIG. 10 presents a distortion diagram for a pair of embossing rolls, in accord with the present invention, wherein the male embossing roll has a smaller diameter $DIA_S$ and the female imprint roll has a large diameter $DIA_L$. Distortion is herein defined as the difference in length, in the machine direction, between the extended elliptical imprint cell 170, of the present invention, and the typical prior art imprint cell 120 as illustrated in FIGS. 5 and 6. The distortion diagram, FIG. 10, is provided to visualize the configuration and relationship of the embossing roll 500, the imprint roll 502, embossing projections 104 and imprint cells 170 as configured in accord with the present invention as when rolls of different size are used.

The circumferential, straight line length of the imprint cell 170 in the machine direction MD, from its leading edge 132 to its trailing edge 134, is defined as the chord length $c_S$; $c_S$ is also the chord length of the two circles that represent the embossing roll 500 and the imprint roll 502, is seen in FIG. 10. The arc length $l_S$ of the imprint cell's bottom surface 172, as measured on an arc through the extended cell, may be calculated by the formulation given below.

The pattern depth PD of imprint cell 170, which also represents the height of the male projection 104, without any clearance allowance, is also calculated by the formulation given below.

In designing an imprint cell 170 the chord length $c_S$ is calculated to determine if there will be overlap between imprint cells.

The arc segment height $h_S$, measured between the chord $c_S$ and the depth of the pattern, on one circle, is added to arc segment height $h_L$ from the second circle to obtain the maximum height of the male embossing projection 104, without any clearance allowance.

The side wall angle of the imprint cell 170, is typically between 0 to 30 degrees.

The calculations to determine the chord cs, the maximum projection height PD, and the arc length $l_S$ of the imprint cell 170, are made to determine whether the imprint cells 170 will run together. It is desired to have a space 138 between the imprint cells 170.

In FIG. 10 the following definitions and formulations apply when the male embossing roll 500 diameter is smaller than the diameter of the female imprint roll 502:

$DIA_L$=Diameter of Large Roll 500

$DIA_S$=Diameter of Small Roll 502

$DIA_M$=Diameter of Male Protrusion 104

$h_L$=Arc Segment Height of Large Roll $h_S$=Arc Segment Height of Small Roll

PD=Pattern Depth $r_L$=Radius of Large Roll $l_L$=Arc Length of Large Roll $l_S$=Arc Length of Small Roll =Sidewall Angle $h_S=[(DIA_L \div DIA_L)\times PD]\div[1+(DIA_L \div DIA_S)]$ $h_L=[(DIA_S \div DIA_L)\times PD]\div[1+(DIA_S \div DIA_L)]$ $l_L=[(r_L\times\pi)\times[2\times[\cos^{-1}[(r_L-h_L)\div r_L]]]]\div 180$ $l_S=[(r_S\times\pi)\times[2\times[\cos^{-1}[(r_S-h_S)\div r_S]]]]\div 180$ However, when the male embossing roll 500 is larger than the female imprint roll the following parameters change accordingly:

$d_S=[[[0.5\times l_L\times(DIA_S\pm DIA_L)]-(\text{Tan}\pm PD)]-(0.5'l_S)]\times 2$ and the cell length becomes:

$c_S=d_S+DIA_M$

When embossing roll 500is smaller than imprint roll 502:

$d_L=[[[0.5\times l_S\times(DIA_L \div DIA_S)]-(\text{Tan}\times PD)]-(0.5\times 1_L)]\times 2$ and the imprint cell length becomes:

$C_L=d_L+DIA_M$

As stated above sweep means the difference in peripheral speed of a point on the embossing projection 104, and a point on the imprint cell 170.

The distortion diagram, as illustrated in FIG. 10, and the above formulations are used to determine the length of the imprint cell in the machine direction MD.

The difference between the diameter of the male embossing roll 500 and the female imprint roll 502, is determined by the amount of sweep needed to remove debris from the imprint cells 170 within imprint roll 502. The difference in the diameter between the embossing roll 502 and the imprint roll 502 is limited by the stretch in the paper web being embossed.

The embossable paper web must be chosen to have an adequate stretch so that the web will impress when the rolls are operated at different linear speeds, without tearing the web. Further the embossable paper must produce an attractive impression, formed at the bearing surface between the sides of the projection 104, and the sides of the cells 170.

Embossable paper is typically sold in different weights and different stretch percentages. A typical embossable paper may be between six percent stretchable to rupture, to twenty percent stretchable to rupture. The apparatus typically used to emboss embossible paper generally works with a defined stretch percentage.

Papers of varied stretch were used in testing the present invention. Embossing, employing the present invention, was successfully performed with a forty percent difference in diameter between the large roll and the small roll. It is believed that the maximum difference in diameter would be a ratio of one to two and that the range of one-to-ten percent is preferred to effectively clear debris from the imprint roll cells during embossing.

A test should be performed, with each source of paper, to determine the amount of speed differential (sweep) that a particular paper will accept without tearing and providing a sharp, clearly differentiated, embossing pattern.

The amount of sweep (speed differential) necessary to sweep debris from an imprint cell, is largely based on the amount of stretch in the paper web. The amount of stretch, of a particular paper web, can be defined and obtained from physical testing of the web, to assure that the web stretch is within the desired operating parameters of a given embossing machine.

As a given web is embossed, the web will stretch at the point of embossing, and relax after the embossing; the sweep (speed differential) is determined by the amount of debris in the web fed to the nip, the amount of sweep necessary to clean out a cell, and by the debris formed by the pattern chosen.

The best method determined, is that the difference between the diameter of the embossing roll, and the imprint roll, is between two percent and 40 percent, with both rolls moving at the same radial speed, to mesh the male projections and the elongated imprint cells at the nip.

The following chart presents diameter differences between rolls necessary to create a particular sweep.

| % Sweep | $Dia_S$ | $Dia_L$ | Cell length |
|---|---|---|---|
| 20% | 4.036 | 4.865 | 0.1046 |
| 25% | 4.036 | 5.045 | 0.1222 |
| 30% | 4.036 | 5.247 | 0.1422 |
| 35% | 4.036 | 5.449 | 0.1624 |
| 40% | 4.036 | 5.650 | 0.1828 |
| 45% | 4.036 | 5.852 | 0.2035 |
| 50% | 4.036 | 6.054 | 0.2244 |

By way of an example the following parameters have been calculated for an embossing machine, in accord with the present invention, having large diameter imprint roll and a smaller diameter embossing roll:

Given the following parameters:

Small Roll Diameter=4.036" (imprint roll)

Large Roll Diameter=5.650" (embossing roll)

Pattern Depth=0.016"

Male Protrusion Diameter=0.0360"

Sidewall angle=15°

Sweep=40%

The following calculated parameters in accord with the above formulations are:

$$h_S = [(5.650 \div 4.036)(.016)] \div [1 + (5.650 \div 4.036)]$$
$$= 0.009333058''$$
$$h_L = [[(4.036 \div 5.650)(.016)]] \div 1 + (4.036 \div 5.650)$$
$$= 0.006666942''$$
$$l_L = (2.825)(\pi)[2[\cos - 1(2.825 - .006666942 \div 2.825)]] \div 180$$
$$= .388242441$$
$$l_S = (2.018)(\pi)[2[\cos - 1(2.018 - .009333058 \div 2.018)]] \div 180$$
$$= .388315818''$$

When the male embossing roll is smaller:

$$d_L = [[[(.5)(.388315818)(5.650 \div 4.036)] - [\mathrm{TAN}\,15^\circ(.016)]] - [(.5)(.388242441)]](2)$$
$$= 0.1468$$
$$c_L = 0.1468 + 0.0360$$
$$= 0.1828$$

Alternate methods of meshing embossing rolls, take the form of a pair of rolls, timed to mesh at a nip, with the male embossing element, moved through the female cell, at a differential surface speed at mesh, to create the cleaning sweep described, rather than the tamping action in prior art machines.

In accordance with the provisions of the patent statutes, the principle and best mode of my invention has been illustrated and described in what is considered to represent its preferred embodiment. However, it should be understood that the invention can be practiced otherwise than as specifically illustrated and described herein without departing from its spirit or scope. Accordingly, the invention is intended to embrace any and all alternatives, modifications and variations as may fall within the spirit and scope of the appended claims.

I claim:

1. An embossing apparatus for continuously embossing a sheet of material containing adherent debris comprising:

a cylindrical embossing roll having a peripheral surface and being rotatable in a machine direction;

a plurality of projections extending outwardly from said peripheral surface of said embossing roll, said projections having a predetermined length in said machine direction;

a cylindrical imprint roll having a peripheral surface and being rotatable in said machine direction, said imprint roll being mounted parallel and tangent to said embossing roll to form a nip;

a plurality of concave imprint cells formed in said peripheral surface of said imprint roll, said imprint cells having a predetermined length in said machine direction, each of said projections being positioned on said embossing roll to mesh with and extend into a corresponding imprint cell on said imprint roll at said nip, said predetermined length of said corresponding imprint cell being substantially longer than said predetermined length of its corresponding projection; and, wherein the sheet of material leaves its debris in said imprint cells when the sheet of material is feed through said nip, and each of said projections moves at a different tangential velocity in said machine direction than its said corresponding imprint cell at said nip, and each of said projections sweeps through and removes the debris from its said corresponding imprint cell at said nip.

2. The embossing apparatus of claim 1, and wherein each of said imprint cells has a leading edge, trailing edge and a floor, and said floor has a smooth concave, curved surface extending into said imprint roll between said leading and trailing edges.

3. The embossing apparatus of claim 2, and wherein said curved surface of said floor of said imprint cell has an elliptical shape extending into said imprint roll.

4. The embossing apparatus of claim 1, and wherein said linear speed of said projections is greater than said linear speed of said cells at said nip, each of said projections sweeping through its said corresponding imprint cell as said projection meshes with its said corresponding imprint cell.

5. The embossing apparatus of claim 1, and wherein said linear speed of said projection is less than said linear speed of its said corresponding said cell at said nip, each of said corresponding imprint cells sweeping past its said projection as its said projection meshes with its said corresponding cell.

6. The embossing apparatus of claim 1, and further comprising means for rotating said embossing and imprinting rolls, and means for feeding and removing said sheet of material from said nip.

7. Apparatus for removing a contaminant from an embossing machine comprising:

a cylindrical embossing roll having a peripheral surface and being rotatable in a machine direction;

a plurality of projections extending outwardly from said peripheral surface of said embossing roll, said projections having a predetermined length in said machine direction;

a cylindrical imprint roll having a peripheral surface and being rotatable in said machine direction, said imprint roll being mounted parallel and tangent to said embossing roll to form a nip;

a plurality of concave imprint cells formed in said peripheral surface of said imprint roll, said imprint cells having a predetermined length in said machine direction, each of said projections being positioned on said embossing roll to mesh with and extend into a corresponding imprint cell on said imprint roll at said nip, said predetermined length of said corresponding imprint cell being substantially longer than said predetermined length of its corresponding projection; and, wherein each of said projections moves at a different tangential velocity in said machine direction than its said corresponding imprint cell at said nip, and each of said projections sweeps through and removes the contaminant from its said corresponding imprint cell at said nip.

8. In a continuous web embossing machine having an embossing roll and an opposing imprint roll, said rolls being in parallel and tangential alignment to form a nip and rotating in a machine direction, said embossing roll having a cylindrical surface with a plurality of embossing projections extending outwardly therefrom, each of said projections having a predetermined length in said machine direction, said imprint roll having a cylindrical surface with a plurality of concave imprint cells therein, each imprint cell having a predetermined length in said machine direction, each of said projections being in matched relation to a corresponding imprint cell at said nip, the improvement being that said cylindrical surface of said embossing roll moves at a first tangential velocity while said imprint roll moves at a second tangential velocity different from said first tangential velocity, and said length of each of said corresponding imprint cells being greater than said length of its said corresponding projection.

9. The improved continuous paper web embossing machine of claim 8, and wherein said embossing and imprint rolls rotate at a same rotational speed.

10. The improved continuous paper web embossing machine of claim 9, and wherein said first tangential velocity is greater than said second tangential velocity.

11. The improved continuous paper web embossing machine of claim 9, and wherein said first tangential velocity is less than said second tangential velocity.

12. The improved continuous paper web embossing machine of claim 8, and wherein said embossing roll has a diameter with a first predetermined length and said imprint roll has a diameter with a second predetermined length, and said lengths of said diameters are different.

13. The improved continuous paper web embossing machine of claim 12, and wherein said first predetermined length of said embossing roll is less than said second predetermined length of said imprint roll.

14. The improved continuous paper web embossing machine of claim 12, and wherein said lengths of said diameters of said rolls have a ratio of less than 1to 1.5.

15. The improved continuous paper web embossing machine of claim 12, and wherein said lengths of said diameters of said rolls differ by five percent.

16. The improved continuous paper web embossing machine of claim 8, and wherein each of said imprint cells has a leading edge, a trailing edge and a floor, said floor being formed by a smooth curved surface extending from said leading edge to said trailing edge.

17. The improved continuous paper web embossing machine of claim 16, and wherein said smooth curved cell surface approximates an elliptical curve.

18. The improved continuous paper web embossing machine of claim 16 and wherein said smooth curved cell surface has a circular arc shape.

19. A method of embossing a continuous sheet of material comprising the steps of:

providing a first embossing roll adapted to rotate in a machine direction, said embossing roll having a cylindrical surface with a plurality of projections extending outwardly therefrom, said projections having a predetermined length in said machine direction;

providing a second imprint roll adapted to rotate in said machine direction, said imprint roll having a cylindrical surface with a plurality of concave cells therein, said concave cells having a predetermined length in said machine direction that is substantially longer than said predetermined length of said embossing projections;

aligning said rolls in a parallel and tangential relationship to form a nip therebetween, each of said projections meshing with and extending into a corresponding concave cell at said nip;

rotating said embossing roll in said machine direction to achieve a first surface speed for said cylindrical surface of said embossing roll;

rotating said imprint roll in said machine direction to achieve a second surface speed for said cylindrical surface of said imprint roll, said surface speed of said imprint roll being different than said surface speed of said embossing roll, each of said projections sweeping through its said corresponding concave cell at said nip; and, passing the continuous sheet of material through said nip.

20. The method of embossing a continuous sheet of material of claim 19, and wherein said embossing roll has a diameter with a predetermined length and said imprint roll has a diameter with a predetermined length, and said length of said diameter of said imprint roll is greater than said length of said diameter of said embossing roll.

* * * * *